US009802229B2

(12) United States Patent
Hull

(10) Patent No.: US 9,802,229 B2
(45) Date of Patent: Oct. 31, 2017

(54) CLEANING APPARATUS

(71) Applicant: The Boeing Company, Chicago, IL (US)

(72) Inventor: Jerald A. Hull, Charleston, SC (US)

(73) Assignee: THE BOEING COMPANY, Chicago, IL (US)

( * ) Notice: Subject to any disclaimer, the term of this patent is extended or adjusted under 35 U.S.C. 154(b) by 302 days.

(21) Appl. No.: 14/742,891

(22) Filed: Jun. 18, 2015

(65) Prior Publication Data

US 2016/0368032 A1 Dec. 22, 2016

(51) Int. Cl.
*B08B 9/093* (2006.01)
*F01D 25/00* (2006.01)

(52) U.S. Cl.
CPC ..... *B08B 9/093* (2013.01); *F01D 25/002* (2013.01)

(58) Field of Classification Search
CPC ..... F01D 25/002; B08B 9/093
See application file for complete search history.

(56) References Cited

U.S. PATENT DOCUMENTS 3,477,178 A 11/1969 Hulbert, Jr.
4,563,841 A * 1/1986 Hart ..... B24C 3/325 118/DIG. 10
4,690,159 A * 9/1987 Vadakin ..... B08B 9/0433 122/392
5,352,298 A * 10/1994 Moulder ..... B60S 3/008 118/306
5,720,310 A * 2/1998 Moulder ..... B05B 3/02 134/167 R
2006/0054202 A1* 3/2006 Luke ..... B08B 3/024 134/167 R
2015/0313191 A1* 11/2015 Snyder ..... A01K 63/003 15/246.5

* cited by examiner

*Primary Examiner* — Alexander Markoff
(74) *Attorney, Agent, or Firm* — Yee & Associates, P.C.

(57) ABSTRACT

A method and apparatus for cleaning a vessel. The apparatus comprises a retractable assembly and a self-propelled cleaning carriage. The retractable assembly has a center section, a first segmented arm configured to extend in a first direction from the center section in an interior of a vessel, and a second segmented arm configured to extend in a second direction from the center section in the interior of the vessel. The second direction is opposite the first direction. The self-propelled cleaning carriage surrounds at least a portion of the retractable assembly. The self-propelled cleaning carriage is configured to move along at least one of the first segmented arm or the second segmented arm.

20 Claims, 12 Drawing Sheets

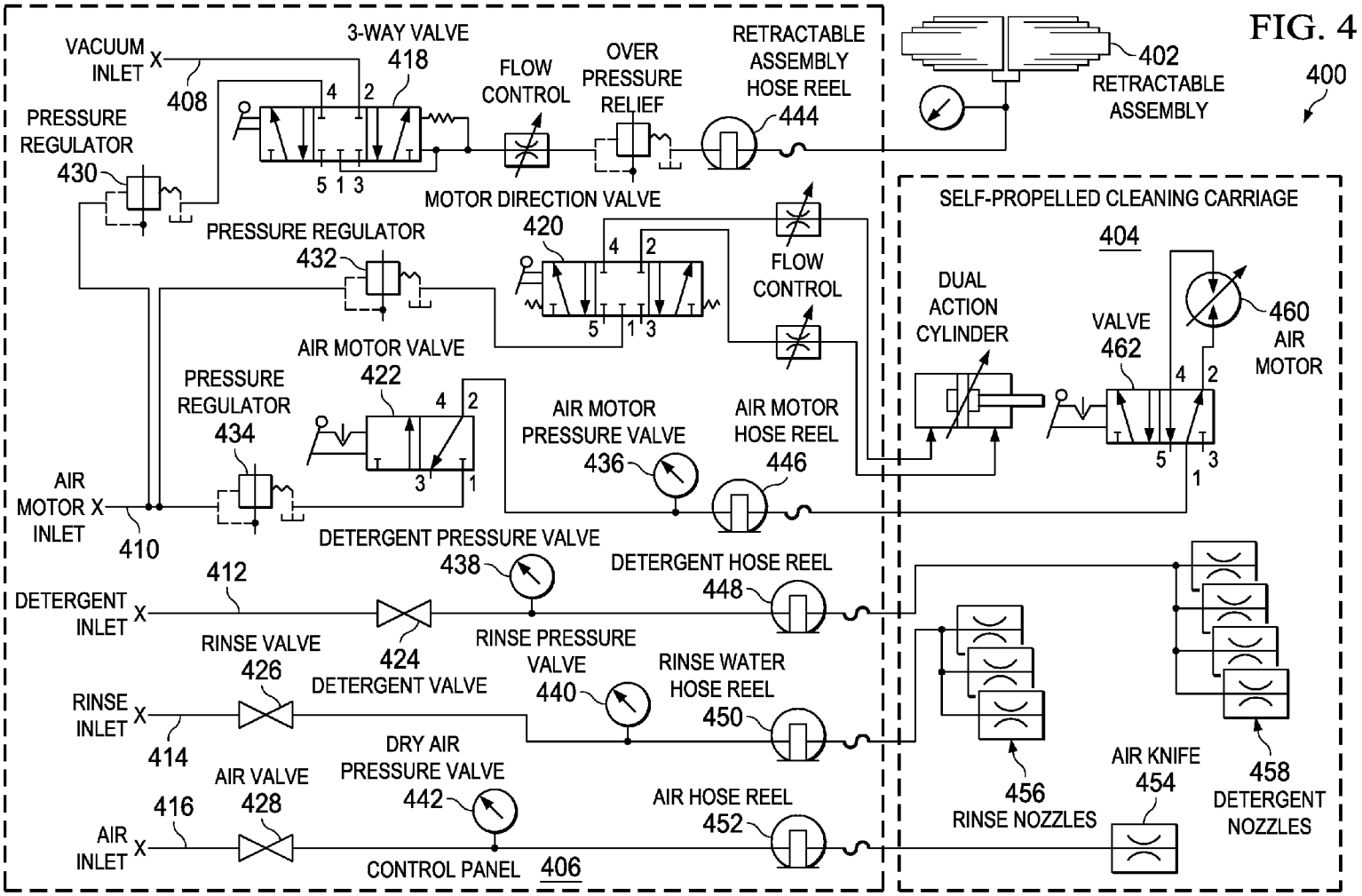
FIG. 4
400
402
RETRACTABLE ASSEMBLY
SELF-PROPELLED CLEANING CARRIAGE
404
460
AIR MOTOR
VALVE 462
DUAL ACTION CYLINDER
458
DETERGENT NOZZLES
AIR KNIFE 454
456
RINSE NOZZLES
RETRACTABLE ASSEMBLY HOSE REEL 444
OVER PRESSURE RELIEF
FLOW CONTROL
3-WAY VALVE 418
MOTOR DIRECTION VALVE 420
FLOW CONTROL
AIR MOTOR HOSE REEL 446
AIR MOTOR PRESSURE VALVE 436
AIR MOTOR VALVE 422
PRESSURE REGULATOR 432
PRESSURE REGULATOR 434
DETERGENT HOSE REEL 448
DETERGENT PRESSURE VALVE 438
RINSE WATER HOSE REEL 450
RINSE PRESSURE VALVE 440
AIR HOSE REEL 452
DRY AIR PRESSURE VALVE 442
CONTROL PANEL 406
DETERGENT VALVE 424
RINSE VALVE 426
AIR VALVE 428
408
412
414
416
410
VACUUM INLET X
PRESSURE REGULATOR 430
AIR MOTOR X INLET
DETERGENT INLET X
RINSE INLET X
AIR INLET X

CLEANING APPARATUS

BACKGROUND INFORMATION

1. Field

The present disclosure relates generally to a cleaning apparatus. More particularly, the present disclosure relates to a cleaning apparatus for the interior of a vessel. Still more particularly, the present disclosure relates to a method and apparatus for cleaning the interior of an aircraft fuel tank.

2. Background

Manufacturing aircraft components may produce undesirable byproducts. For example, when drilling, welding, riveting, or performing other types of manufacturing processes to create an aircraft fuel tank, undesirable conditions such as dust, debris, or other material may be created within the interior. Before deploying the aircraft for use, it may be desirable to remove the dust, debris, or other undesirable material from the fuel tank.

Currently, an operator may work inside the confined spaces of an aircraft fuel tank to remove any undesirable material. Cleaning an aircraft fuel tank may be an undesirable task due to the confined space. Further, an operator may don protective equipment to clean an aircraft fuel tank. The protective equipment may limit visibility. Due to limited visibility, operators may incur bodily injury due to bumping into structures internal to an aircraft fuel tank such as brackets, stringers, pipes, or other structures. Yet further, an operator may have to contort his body into undesirable positions to apply detergents, to scrub, and to rinse hard to reach areas.

In some situations, an operator may inadvertently apply too much pressure and reduce the quality of an aircraft fuel tank. Reworking the interior of an aircraft fuel tank may be unplanned and undesirably time consuming.

Therefore, it would be desirable to have a method and apparatus that take into account at least some of the issues discussed above, as well as other possible issues. For example, it may be desirable to have a method and apparatus to allow for automatically cleaning an aircraft fuel tank. As another example, it may be desirable to have a method and apparatus to allow for cleaning an aircraft fuel tank without reducing the quality of the fuel tank.

SUMMARY

In an illustrative embodiment, an apparatus is provided. The apparatus comprises a retractable assembly and a self-propelled cleaning carriage. The retractable assembly has a center section, a first segmented arm configured to extend in a first direction from the center section in an interior of a vessel, and a second segmented arm configured to extend in a second direction from the center section in the interior of the vessel. The second direction is opposite the first direction. The self-propelled cleaning carriage surrounds at least a portion of the retractable assembly. The self-propelled cleaning carriage is configured to move along at least one of the first segmented arm or the second segmented arm.

In another illustrative embodiment, an apparatus is provided. The apparatus comprises a retractable assembly, a pneumatic system, and a self-propelled cleaning carriage. The retractable assembly comprises a center section, a first segmented arm, a second segmented arm, a first gripper, and a second gripper. The first segmented arm has a first plurality of concentric hollow rods. The first segment arm is configured to extend in a first direction from the center section in an interior of a vessel. The second segmented arm has a second plurality of concentric hollow rods. The second segmented arm is configured to extend in a second direction from the center section in the interior of the vessel. The second direction is opposite the first direction. The first gripper is attached to the first segmented arm. The second gripper is attached to the second segmented arm. The pneumatic system is associated with the retractable assembly. The self-propelled cleaning carriage surrounds at least a portion of the retractable assembly. The self-propelled cleaning carriage is configured to move along at least one of the first segmented arm or the second segmented arm.

In yet another illustrative embodiment, a method is provided. A first segmented arm of a retractable assembly is extended in a first direction relative to a center section of the retractable assembly such that the retractable assembly contacts a first wall of a vessel. A second segmented arm of the retractable assembly is extended in a second direction relative to a center section of the retractable assembly such that the retractable assembly contacts a second wall of the vessel. The second direction is opposite the first direction. A self-propelled cleaning carriage is propelled along the retractable assembly.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

FIG. 4 is an illustration of a flow diagram of a circuit diagram of a cleaning system in accordance with an illustrative embodiment;

DETAILED DESCRIPTION

Figure 1:
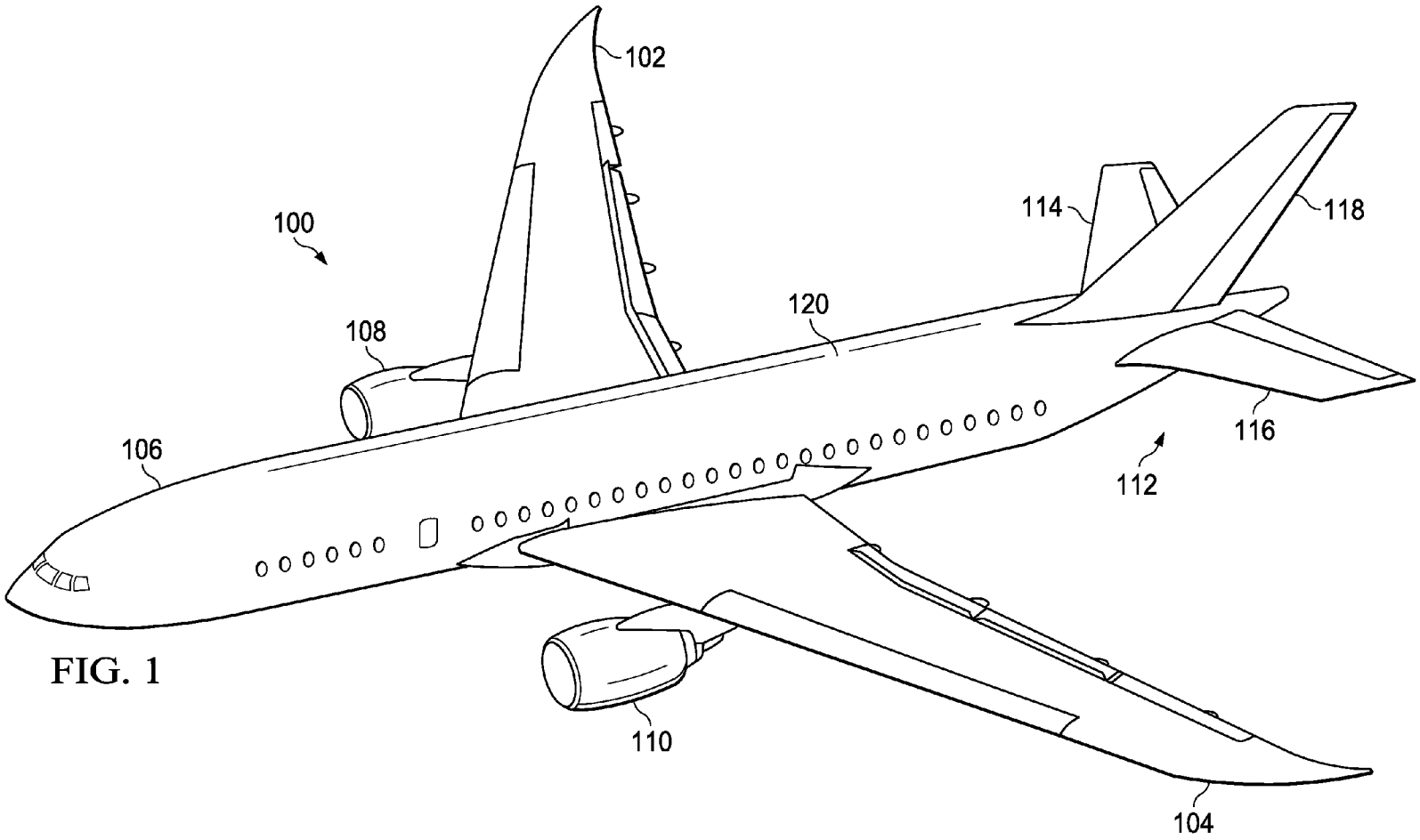
FIG. 1 is an illustration of an aircraft in accordance with an illustrative embodiment may be implemented.

With reference now to the figures, and in particular, with reference to FIG. 1, an illustration of an aircraft is depicted in accordance with an illustrative embodiment. In this illustrative example, aircraft 100 has wing 102 and wing 104 attached to body 106. Aircraft 100 includes engine 108 attached to wing 102 and engine 110 attached to wing 104.

Body 106 has tail section 112. Horizontal stabilizer 114, horizontal stabilizer 116, and vertical stabilizer 118 are attached to tail section 112 of body 106. Body 106 may have composite skin 120.

Aircraft 100 is an example of an aircraft in which a cleaning structure may be used in accordance with an illustrative embodiment. In one illustrative example, a cleaning structure may be used in a fuel tank in at least one of wing 102, wing 104, or body 106 of aircraft 100. For example, a cleaning structure may be used to clean a bay of a fuel tank in at least one of wing 102, wing 104, or body 106 of aircraft 100.

As used herein, the phrase "at least one of," when used with a list of items, means different combinations of one or more of the listed items may be used and only one of each item in the list may be needed. For example, "at least one of item A, item B, and item C" may include, without limitation, item A or item A and item B. This example also may include item A, item B, and item C or item B and item C. The item may be a particular object, thing, or a category. In other words, at least one of means any combination of items and number of items may be used from the list but not all of the items in the list are required.

The illustration of aircraft 100 in FIG. 1 is not meant to imply physical or architectural limitations to the manner in which an illustrative configuration may be implemented. For example, although aircraft 100 is a commercial aircraft, aircraft 100 may be a military aircraft, a rotorcraft, a helicopter, an unmanned aerial vehicle, or any other suitable aircraft.

Although the illustrative examples for an illustrative embodiment are described with respect to an aircraft, an illustrative embodiment may be applied to other types of platforms. The platform may be, for example, a mobile platform, a stationary platform, a land-based structure, an aquatic-based structure, and a space-based structure. More specifically, the platform, may be a surface ship, a tank, a personnel carrier, a train, a spacecraft, a space station, a satellite, a submarine, an automobile, a power plant, a bridge, a dam, a house, a windmill, a manufacturing facility, a building, and other suitable platforms.

Figure 2:
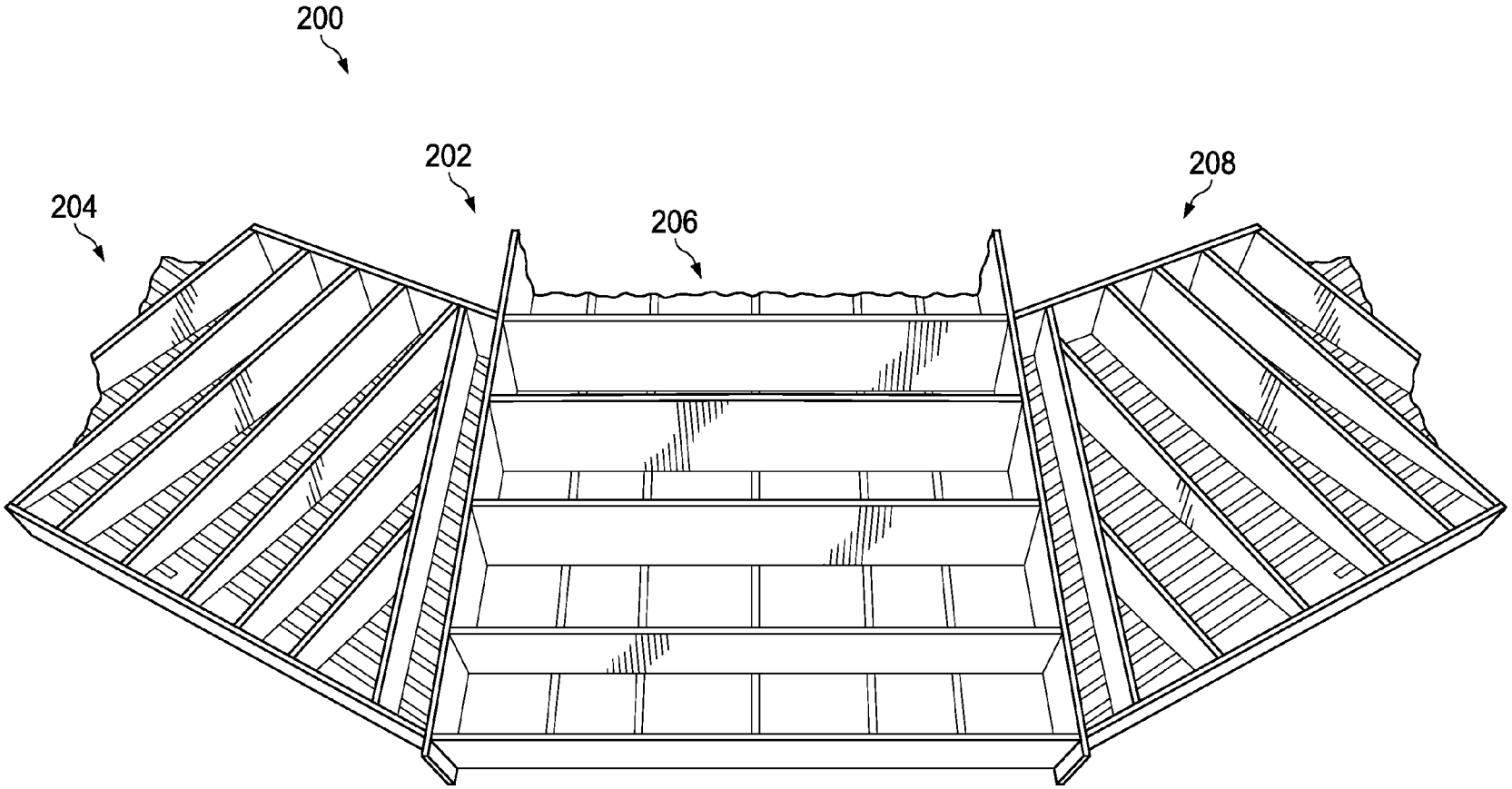
FIG. 2 is an illustration of a fuel tank of an aircraft in accordance with an illustrative embodiment.

Turning now to FIG. 2, an illustration of a fuel tank of an aircraft is depicted in accordance with an illustrative embodiment. Fuel tank 200 may be an example of a fuel tank of aircraft 100 of FIG. 1. Fuel tank 200 may have plurality of bays 202. Plurality of bays 202 may be located in left portion 204, center portion 206, and right portion 208. Center portion 206 may be positioned in body 106 of aircraft 100. Left portion 204 may be positioned in wing 104 of aircraft 100. Right portion 208 may be positioned in wing 102 of aircraft 100.

A cleaning system may be installed in a first bay of plurality of bays 202. After a cleaning process is performed on the first bay, the cleaning system may be removed from the first bay of plurality of bays 202 and moved.

Figure 3:
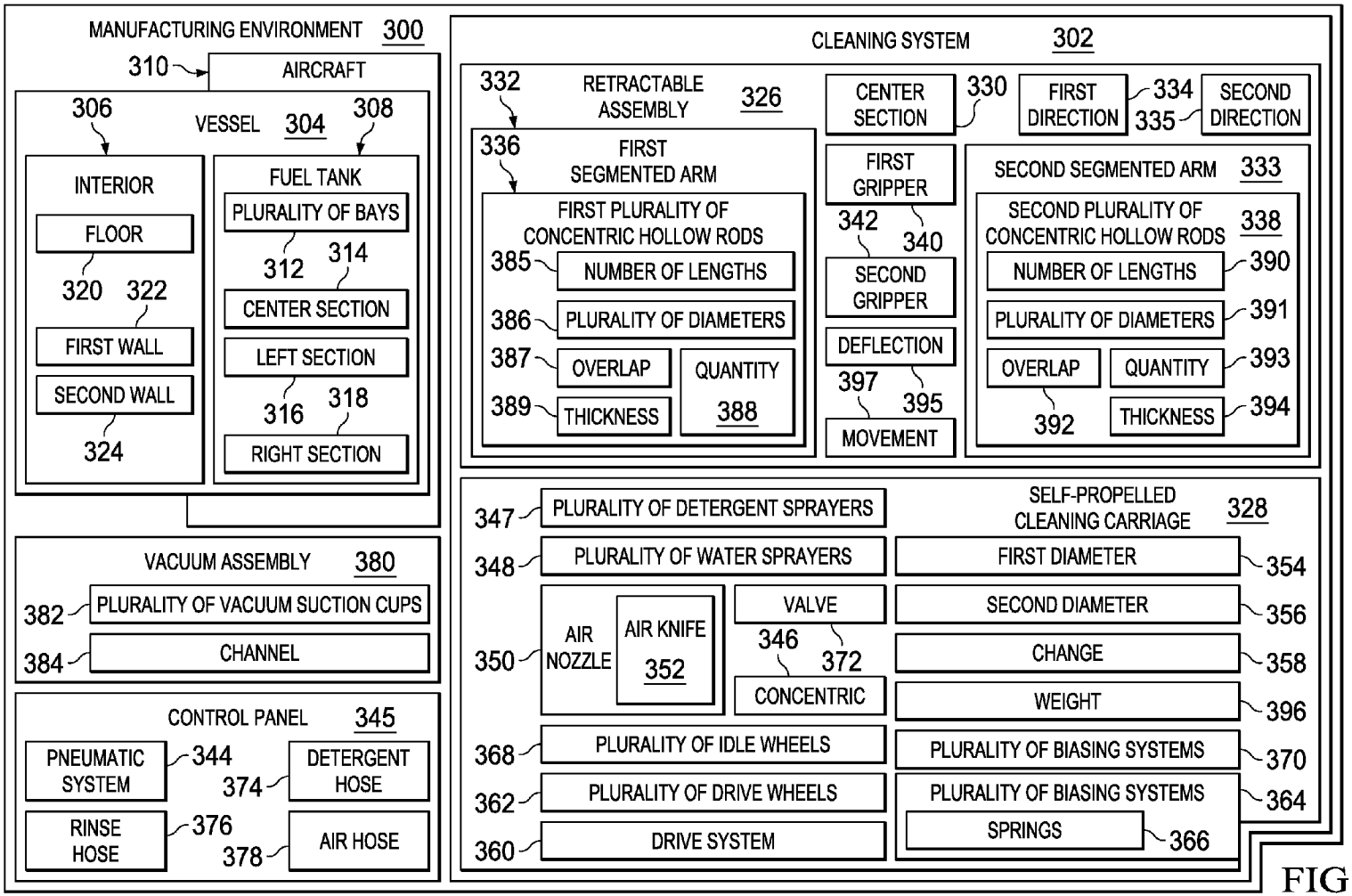
FIG. 3 is an illustration of a block diagram of a manufacturing environment in accordance with an illustrative embodiment.

With reference now to FIG. 3, an illustration of a block diagram of a manufacturing environment is depicted in accordance with an illustrative embodiment. In this illustrative example, manufacturing environment 300 is depicted in block form to illustrate different components for one or more illustrative embodiments. In this depicted example, manufacturing environment 300 includes cleaning system 302 and vessel 304. Cleaning system 302 may be installed in vessel 304 to clean interior 306 of vessel 304. Vessel 304 may be any desirable substantially enclosed space. For example, vessel 304 may be a shipping container, a tanker, an animal tank, a room, or other desirable type of vessel.

In some illustrative examples, vessel 304 may be fuel tank 308 of aircraft 310. Aircraft 100 of FIG. 1 may be a physical implementation of aircraft 310. Fuel tank 200 of FIG. 2 may be a physical implementation of fuel tank 308. Fuel tank 308 may have plurality of bays 312. In some illustrative examples, fuel tank 308 may have center section 314, left section 316, and right section 318. In some illustrative examples, when vessel 304 takes the form of fuel tank 308, interior 306 may be a bay of plurality of bays 312.

Interior 306 of vessel 304 may have floor 320, first wall 322, and second wall 324. Cleaning system 302 may be installed in interior 306 of vessel 304 by contacting at least one of first wall 322 or second wall 324.

Cleaning system 302 may include retractable assembly 326 and self-propelled cleaning carriage 328. Self-propelled cleaning carriage 328 may move along retractable assembly 326 to clean interior 306 of vessel 304.

Retractable assembly 326 may include center section 330, first segmented arm 332, and second segmented arm 333. First segmented arm 332 may be attached to a first side of center section 330. First segmented arm 332 may be configured to extend in first direction 334 from center section 330. Second segmented arm 333 may be attached to a second side of center section 330. Second segmented arm 333 may be configured to extend in second direction 335. Second direction 335 may be opposite first direction 334. First segmented arm 332 may include first plurality of concentric hollow rods 336. First plurality of concentric hollow rods 336 may include any desirable number of concentric hollow rods. For example, first plurality of concentric hollow rods 336 may include two concentric hollow rods. In other illustrative examples, first plurality of concentric hollow rods 336 may include more than two rods. In one illustrative example, first plurality of concentric hollow rods 336 may include three concentric hollow rods. Retractable assembly 326 may be designed such that neither first segmented arm 332 nor second segmented arm 333 may bind up due to weight or extension length.

The length of each of first plurality of concentric hollow rods 336 may be selected based on performance metrics for cleaning system 302. For example, the length of each of first plurality of concentric hollow rods 336 may be selected based on distance between first wall 322 and second wall 324. The length of each of first plurality of concentric hollow rods 336 may be selected to result in a specific length, weight, or other characteristic for retractable assembly 326.

Second segmented arm 333 may include second plurality of concentric hollow rods 338. Second plurality of concentric hollow rods 338 may include any desirable number of concentric hollow rods. For example, second plurality of concentric hollow rods 338 may include two concentric hollow rods. In other illustrative examples, second plurality of concentric hollow rods 338 may include more than two rods. In one illustrative example, second plurality of concentric hollow rods 338 may include three concentric hollow rods.

The length of each of second plurality of concentric hollow rods 338 may be selected based on performance metrics for cleaning system 302. For example, the length of each of second plurality of concentric hollow rods 338 may be selected based on the distance between first wall 322 and second wall 324. The length of each of second plurality of concentric hollow rods 338 may be selected to result in a specific length, weight, or other characteristic for retractable assembly 326.

In some illustrative examples, first plurality of concentric hollow rods 336 and second plurality of concentric hollow rods 338 may be substantially the same. For example, at least one of the number of, the weight of, or the length of each of first plurality of concentric hollow rods 336 and second plurality of concentric hollow rods 338 may be substantially the same.

First gripper 340 may be attached to first segmented arm 332. Second gripper 342 may be attached to second segmented arm 333. In some illustrative examples, retractable assembly 326 may be extended such that retractable assembly 326 contacts first wall 322 and second wall 324 of vessel 304. For example, first segmented arm 332 may be extended such that first gripper 340 contacts first wall 322 of vessel 304. Second segmented arm 333 may be extended such that second gripper 342 contacts second wall 324 of vessel 304.

In some illustrative examples, first segmented arm 332 and second segmented arm 333 may be extended using pneumatic system 344. Pneumatic pressure from pneumatic system 344 may move the smaller, inner diameter sections of first plurality of concentric hollow rods 336 outward. Pneumatic pressure from pneumatic system 344 may move the smaller, inner diameter sections of second plurality of concentric hollow rods 338 outward. Pneumatic pressure from pneumatic system 344 may hold retractable assembly 326 and self-propelled cleaning carriage 328 in place within vessel 304 against the force of gravity. First gripper 340 and second gripper 342 may provide friction sufficient to hold retractable assembly 326 and self-propelled cleaning carriage 328 in place within vessel 304 against the force of gravity.

Pneumatic pressure supplied by pneumatic system 344 to retractable assembly 326 may be controlled by control panel 345. Control panel 345 may include a number of valves, inlets, hose reels, pressure regulators, pressure meters, or other desirable components. Control panel 345 may be a support structure located outside of vessel 304. Control panel may be present outside of vessel 304 when cleaning system 302 is placed within vessel 304.

Self-propelled cleaning carriage 328 may move along retractable assembly 326 including along first segmented arm 332 and second segmented arm 333 to clean interior 306 of vessel 304. During extension of first segmented arm 332 and second segmented arm 333, self-propelled cleaning carriage 328 may be positioned on center section 330.

Self-propelled cleaning carriage 328 may be concentric 346 with retractable assembly 326. Self-propelled cleaning carriage 328 may have plurality of detergent sprayers 347, plurality of water sprayers 348, and air nozzle 350. Plurality of detergent sprayers 347 may spray detergent onto interior 306 as self-propelled cleaning carriage 328 travels along retractable assembly 326. Plurality of water sprayers 348 may spray rinse water onto interior 306 as self-propelled cleaning carriage 328 travels along retractable assembly 326. Air nozzle 350 may spray air onto interior 306 to move rinse water and debris within interior 306 of vessel 304. Air nozzle 350 may dry interior 306 of vessel 304.

Air nozzle 350 may take the form of air knife 352. Air knife 352 may direct compressed air. Air knife 352 may be a high intensity uniform sheet of laminar airflow.

In some illustrative examples, self-propelled cleaning carriage 328 may have first diameter 354 and second diameter 356. Air knife 352 may be positioned at change 358 in diameter between first diameter 354 and second diameter 356. In some illustrative examples, first diameter 354 and second diameter 356 may be selected such that self-propelled cleaning carriage 328 may move within vessel 304 with a restricted clearance. For example, vessel 304 may include internal structures such as brackets, stringers, ribs, pipes, or other structures. In some illustrative examples, first diameter 354 and second diameter 356 may be selected such that self-propelled cleaning carriage 328 may move within vessel 304 without contacting the internal structures.

Drive system 360 may propel self-propelled cleaning carriage 328 along retractable assembly 326. In some illustrative examples, drive system 360 may include an air motor and a gear box. When drive system 360 includes an air motor, compressed air may be supplied to the air motor. The air motor may apply torque to a gear box with a plurality of outputs. Each of the plurality of outputs may drive one of plurality of drive wheels 362. In these illustrative examples, the speed of self-propelled cleaning carriage 328 may be proportional to the air pressure supplied to drive system 360.

Each of plurality of drive wheels 362 may have a concave shaped surface. The concave shaped surface of each of plurality of drive wheels 362 may contact retractable assembly 326.

Plurality of biasing systems 364 may bias plurality of drive wheels 362 into contact with retractable assembly 326. Plurality of biasing systems 364 may ensure that plurality of drive wheels 362 contact retractable assembly 326 as self-propelled cleaning carriage 328 travels across at least one of first plurality of concentric hollow rods 336 or second plurality of concentric hollow rods 338. In some illustrative examples, plurality of biasing systems 364 may include springs 366. Springs 366 may bias plurality of drive wheels 362 towards retractable assembly 326 as self-propelled cleaning carriage 328 moves between concentric hollow rods having different diameters. For example, springs 366 may bias plurality of drive wheels 362 towards retractable assembly 326 as self-propelled cleaning carriage 328 moves from one diameter to another of at least one of first plurality of concentric hollow rods 336 or second plurality of concentric hollow rods 338. Plurality of biasing systems 364 may provide substantially constant pinching force by plurality of drive wheels 362 to retractable assembly 326.

In some illustrative examples, plurality of drive wheels 362 may include three wheels. In some other illustrative examples, plurality of drive wheels 362 may include greater or less than three wheels.

Cleaning system 302 may also include plurality of idle wheels 368. Plurality of idle wheels 368 may contact retractable assembly 326 as self-propelled cleaning carriage 328 moves along retractable assembly 326. Plurality of idle wheels 368 may be associated with plurality of biasing systems 370. Plurality of biasing systems 370 may bias plurality of idle wheels 368 towards retractable assembly 326 as self-propelled cleaning carriage 328 moves along retractable assembly 326. Plurality of biasing systems 370 may bias plurality of idle wheels 368 towards retractable assembly 326 as self-propelled cleaning carriage 328 moves from one diameter to another of at least one of first plurality of concentric hollow rods 336 or second plurality of concentric hollow rods 338. Plurality of biasing systems 370 may provide substantially constant pinching force by plurality of idle wheels 368 to retractable assembly 326.

Plurality of biasing systems 364 and plurality of biasing systems 370 may provide substantially constant pinching force. Plurality of biasing systems 364 and plurality of biasing systems 370 may provide sufficient force to maintain a prescribed grip on retractable assembly 326 without damaging retractable assembly 326.

Plurality of drive wheels 362, plurality of idle wheels 368, and gravity may provide a desirable degree of freedom stability. For example, when plurality of drive wheels 362 has three drive wheels and plurality of idle wheels 368 has three idle wheels, there may be a 6 degree of freedom stability.

Drive system 360 may drive self-propelled cleaning carriage 328 towards at least one of first wall 322 or second wall 324 of vessel 304. When self-propelled cleaning carriage 328 approaches first wall 322, a component of at least one of first gripper 340 or first segmented arm 332 may interact with valve 372 of self-propelled cleaning carriage 328. In some illustrative examples, valve 372 may be a 2-position pneumatic valve. When valve 372 is actuated, self-propelled cleaning carriage 328 may change direction of movement on retractable assembly 326. For example, when approaching first wall 322, valve 372 may be actuated to move self-propelled cleaning carriage 328 towards second wall 324.

Detergent hose 374 may be connected to self-propelled cleaning carriage 328 to provide detergent to plurality of detergent sprayers 347. Rinse hose 376 may be connected to self-propelled cleaning carriage 328 to provide rinse water to plurality of water sprayers 348. Air hose 378 may be connected to self-propelled cleaning carriage 328 to provide air to air nozzle 350. In some illustrative examples, only one of detergent hose 374, rinse hose 376, or air hose 378 may be connected to self-propelled cleaning carriage 328 as self-propelled cleaning carriage 328 moves along retractable assembly 326.

Self-propelled cleaning carriage 328 may be connected to only one of detergent hose 374, rinse hose 376, or air hose 378 to reduce the weight of self-propelled cleaning carriage 328 as self-propelled cleaning carriage 328 moves along retractable assembly 326. Reducing the weight of self-propelled cleaning carriage 328 may reduce the pneumatic pressure supplied by pneumatic system 344 to hold retractable assembly 326 and self-propelled cleaning carriage 328 in place.

By self-propelled cleaning carriage 328 being connected to only one of detergent hose 374, rinse hose 376, or air hose 378 the force required to propel self-propelled cleaning carriage 328 along retractable assembly 326 may be reduced. Further, by self-propelled cleaning carriage 328 being connected to only one of detergent hose 374, rinse hose 376, or air hose 378, slippage of plurality of drive wheels 362 on retractable assembly 326 may be reduced or eliminated.

Vacuum assembly 380 may be used to remove detergent and rinse water from interior 306 of vessel 304. Vacuum assembly 380 may be positioned at a desirable location within interior 306 of vessel 304. Vacuum assembly 380 may be positioned independently of cleaning system 302. Vacuum assembly 380 may include plurality of vacuum suction cups 382 and channel 384.

Plurality of vacuum suction cups 382 may perform two actions simultaneously. For example, plurality of vacuum suction cups 382 may hold vacuum assembly 380 at a desired position within interior 306 of vessel 304. Plurality of vacuum suction cups 382 may also draw at least one of detergent, rinse water, or debris into channel 384 of vacuum assembly 380. Channel 384 may direct the at least one of detergent, rinse water, or debris out of vessel 304. Channel 384 may take the form of any desirable structure that is suitably flexible to move into and within vessel 304. Channel 384 may take the form of a hose, a flexible tube, or any desirable type of channel.

In some illustrative examples, channel 384 may be formed of more than one structure. For example, channel 384 may be formed of a substantially rigid tube connecting plurality of vacuum suction cups 382 and a hose connecting the substantially rigid tube to the outside of vessel 304.

In illustrative examples in which vessel 304 comprises fuel tank 308 having center section 314, left section 316, and right section 318, multiple vacuum assemblies may be positioned in strategic locations within fuel tank 308. For example, detergent and rinse water from left section 316 and right section 318 may run into center section 314 due to the design of fuel tank 308. In this example, multiple vacuum assemblies including vacuum assembly 380 may be positioned within center section 314.

Characteristics of retractable assembly 326 may be selected in order to maintain position of retractable assembly 326 within vessel 304. For example, dimensions and material of retractable assembly 326 may influence at least one of the strength, flexibility, weight, or other resulting qualities of retractable assembly 326. Qualities of retractable assembly 326 may also be influenced by characteristics of at least one of first plurality of concentric hollow rods 336 or second plurality of concentric hollow rods 338.

Characteristics of first plurality of concentric hollow rods 336 may include number of lengths 385, plurality of diameters 386, overlap 387, quantity 388, and thickness 389. Each of number of lengths 385, plurality of diameters 386, overlap 387, quantity 388, and thickness 389 may influence behavior of first segmented arm 332. In some illustrative examples, number of lengths 385 may each be substantially the same. In other illustrative examples, number of lengths 385 may each be different. Number of lengths 385 may be selected based on the size of vessel 304. When number of lengths 385 is reduced, first segmented arm 332 may have a reduced weight. As a result, in some illustrative examples, number of lengths 385 may be the shortest desirable lengths for use in vessel 304.

Plurality of diameters 386 may be a series of decreasing diameters. When plurality of diameters 386 are decreasing diameters, first plurality of concentric hollow rods 336 may nest within each other. Quantity 388 may be any desirable number of rods. In some illustrative examples, plurality of diameters 386 may be in the range of about 2 inches to about 4 inches. Plurality of diameters 386 may be larger when vessel 304 is larger. Plurality of diameters 386 may be decreased when the size of vessel 304 is decreased.

In some illustrative examples, quantity 388 may be three rods. Further, in some illustrative examples, quantity 388 may be less than three rods. In other illustrative examples, quantity 388 may be more than three rods.

Overlap 387 may be a measure of first plurality of concentric hollow rods 336 that extend over each other so as to cover each other partly. Overlap 387 may decrease when first plurality of concentric hollow rods 336 is extended. Overlap 387 may increase when first plurality of concentric hollow rods 336 is retracted.

A desirable value for overlap 387 when first plurality of concentric hollow rods 336 is extended may be related to thickness 389. The stiffness of first plurality of concentric hollow rods 336 may be related to both thickness 389 and overlap 387. The stiffness of first plurality of concentric hollow rods 336 may be increased by increasing at least one of thickness 389 or overlap 387. Thus, a desirable value for overlap 387 may be lower when thickness 389 is greater. A desirable value for overlap 387 may be higher when thickness 389 is lower. In some illustrative examples, overlap 387 may be expressed as a percentage.

In some illustrative examples, thickness 389 of each of first plurality of concentric hollow rods 336 may be substantially the same. Increasing thickness 389 may increase stiffness of first plurality of concentric hollow rods 336. Increasing thickness 389 may also increase the weight of first plurality of concentric hollow rods 336.

Characteristics of second plurality of concentric hollow rods 338 may include number of lengths 390, plurality of diameters 391, overlap 392, quantity 393, and thickness 394. Each of number of lengths 390, plurality of diameters 391, overlap 392, quantity 393, and thickness 394 may influence behavior of second segmented arm 333. In some illustrative examples, number of lengths 390 may each be substantially the same. In some illustrative examples, number of lengths 390 may each be different. Number of lengths 390 may be selected based on the size of vessel 304. When number of lengths 390 is reduced, second segmented arm 333 may have a reduced weight. As a result, in some illustrative examples, number of lengths 390 may be the shortest desirable lengths for use in vessel 304.

In some illustrative examples, number of lengths 385 and number of lengths 390 may be substantially the same. When number of lengths 385 and number of lengths 390 are substantially the same, center section 330 may be substantially centered within interior 306 of vessel 304.

Plurality of diameters 391 may be a series of decreasing diameters. When plurality of diameters 391 are decreasing diameters, second plurality of concentric hollow rods 338 may nest within each other. Quantity 393 may be any desirable number of rods. In some illustrative examples, plurality of diameters 391 may be in the range of about 2 inches to about 4 inches. Plurality of diameters 391 may be larger when vessel 304 is larger. Plurality of diameters 391 may be decreased when the size of vessel 304 is decreased.

In some illustrative examples, quantity 393 may be three rods. In other illustrative examples, quantity 393 may be less than three rods. In some other illustrative examples, quantity 393 may be more than three rods.

Overlap 392 may be a measure of second plurality of concentric hollow rods 338 that extend over each other so as to cover each other partly. Overlap 392 may decrease when second plurality of concentric hollow rods 338 is extended. Overlap 392 may increase when second plurality of concentric hollow rods 338 is retracted.

A desirable value for overlap 392 when second plurality of concentric hollow rods 338 is extended may be related to thickness 394. The stiffness of second plurality of concentric hollow rods 338 may be related to both thickness 394 and overlap 392. The stiffness of second plurality of concentric hollow rods 338 may be increased by increasing at least one of thickness 394 or overlap 392. Thus, a desirable value for overlap 392 may be lower when thickness 394 is greater. A desirable value for overlap 392 may be higher when thickness 394 is lower. In some illustrative examples, overlap 392 may be expressed as a percentage.

In some illustrative examples, thickness 394 of each of second plurality of concentric hollow rods 338 may be substantially the same. Increasing thickness 394 may increase stiffness of second plurality of concentric hollow rods 338. Increasing thickness 394 may also increase the weight of second plurality of concentric hollow rods 338.

When installed in vessel 304, characteristics of retractable assembly 326 may influence deflection 395. Deflection 395 may be a difference between a vertical position of center section 330 within interior 306 of vessel 304 and a vertical position of first gripper 340 of retractable assembly 326. Some values for deflection 395 may be undesirable. Deflection 395 may be influenced by at least one of characteristics of first segmented arm 332, characteristics of second segmented arm 333, material of retractable assembly 326, or weight 396 of self-propelled cleaning carriage 328.

As self-propelled cleaning carriage 328 travels along retractable assembly 326, retractable assembly 326 may have movement 397. It may be desirable to minimize movement 397. For example, it may be desirable to design retractable assembly 326 to be robust against disturbances. It may be undesirable for retractable assembly 326 to be so flexible that retractable assembly 326 has a low natural frequency. It may also be undesirable for retractable assembly 326 to be so flexible that movement 397 shakes retractable assembly 326 loose from vessel 304.

Cleaning system 302 may allow for cleaning of vessel 304 after manufacturing vessel 304. For example, when drilling, welding, riveting, or other types of manufacturing processes are performed on vessel 304 undesirable conditions such as dust, debris, or other material may be located within interior 306. Before deploying vessel 304 for use, it may be desirable to remove the dust, debris, or other undesirable material from vessel 304.

Cleaning system 302 may allow for removal of the dirt, dust, debris, or other undesirable material without an operator physically spraying or scrubbing interior 306 of vessel 304. An operator may hold cleaning system 302 within vessel 304 while retractable assembly 326 self-deploys. In some illustrative examples, it may not be necessary for an operator to enter vessel 304 before retractable assembly 326 self-deploys. In some illustrative examples, an operator may enter vessel 304 to hold cleaning system 302 as retractable assembly 326 self-deploys. Afterwards, the operator may exit vessel 304 so that cleaning system 302 may clean and dry interior 306 of vessel 304.

When retractable assembly 326 self-deploys, self-propelled cleaning carriage 328 may be positioned on center section 330 of retractable assembly 326. Retractable assembly 326 may be designed to handle lateral loads.

The illustration of manufacturing environment 300 in FIG. 3 is not meant to imply physical or architectural limitations to the manner in which an illustrative embodiment may be implemented. Other components in addition to or in place of the ones illustrated may be used. Some components may be unnecessary. Also, the blocks are presented to illustrate some functional components. One or more of these blocks may be combined, divided, or combined and divided into different blocks when implemented in an illustrative embodiment.

If desired, a number of stands may support cleaning system 302 within vessel 304 temporarily prior to retractable assembly 326 self-deploying. For example, in some illustrative examples, the weight of cleaning system 302 may be supported by two jack stands placed temporarily in vessel 304.

In some illustrative examples, cleaning system 302 may be inserted or removed from vessel 304 without disassembly. For example, self-propelled cleaning carriage 328 may be positioned concentric 346 with retractable assembly 326. As another example, first gripper 340 and second gripper 342 may be attached to first segmented arm 332 and second segmented arm 333 respectively. In some illustrative examples, portions of cleaning system 302 may be disassembled prior to utilizing or removing cleaning system 302 from vessel 304. For example, prior to utilizing cleaning system 302, at least one of first gripper 340, second gripper 342, or self-propelled cleaning carriage 328 may be associated with at least one of first segmented arm 332, second segmented arm 333, or center section 330. As another example, at least one of first gripper 340, second gripper 342, or self-propelled cleaning carriage 328 may be removed from retractable assembly 326 prior to removing cleaning system 302 from vessel 304.

Turning now to FIG. 4, an illustration of a circuit diagram of a cleaning system is depicted in accordance with an illustrative embodiment. View 400 may be one example of connections between retractable assembly 326, self-propelled cleaning carriage 328, and utilities in manufacturing environment 300 in FIG. 3.

View 400 depicts retractable assembly 402, self-propelled cleaning carriage 404, and control panel 406. Self-propelled cleaning carriage 404 may be an implementation of self-propelled cleaning carriage 328 of FIG. 3. Retractable assembly 402 may be an implementation of retractable assembly 326 of FIG. 3. Control panel 406 may be an implementation of control panel 345.

In this illustrative example, control panel 406 includes a plurality of inlets for utilities. Utilities may include at least one of electricity, compressed air, vacuum, detergent, water, or other desirable utility. Each utility may have its own respective inlet. For example, control panel 406 includes vacuum inlet 408, air motor inlet 410, detergent inlet 412, rinse inlet 414, and air inlet 416.

In this illustrative example, control panel 406 includes a plurality of valves. For example, control panel 406 includes 3-way valve 418, motor direction valve 420, air motor valve 422, detergent valve 424, rinse valve 426, and air valve 428. Each valve may control which utilities are provided to retractable assembly 402 or self-propelled cleaning carriage 404 at any time. For example, detergent valve 424 may be actuated to provide detergent to self-propelled cleaning carriage 404. As another example, 3-way valve 418 may provide at least one of air or vacuum to expand or retract retractable assembly 402.

In this illustrative example, control panel 406 includes a number of pressure regulators. Pressure regulators may include pressure regulator 430, pressure regulator 432, and pressure regulator 434. The pressure of the utilities may be different than the pressure of any other utility. For example, the pressure of rinse water provided to self-propelled cleaning carriage 404 may be different than the pressure of detergent supplied to self-propelled cleaning carriage 404.

Control panel 406 may include pressure valves. For example, control panel 406 may include air motor pressure valve 436, detergent pressure valve 438, rinse pressure valve 440, and dry air pressure valve 442. In some illustrative examples, the pressure valves may indicate the pressure of a respective utility to an operator. In some illustrative examples, the pressure valves may control the pressure of a respective utility provided to self-propelled cleaning carriage 404.

Control panel 406 may include a number of hose reels. Each hose reel may maintain tension on a respective hose. As depicted, control panel 406 may include retractable assembly hose reel 444, air motor hose reel 446, detergent hose reel 448, rinse water hose reel 450, and air hose reel 452. Due to the tension provided on each respective hose, it may be desirable to only have one of a detergent hose, a rinse water hose, or an air hose connected to self-propelled cleaning carriage 404 at a time. Having multiple tensioned hoses connected to self-propelled cleaning carriage 404 may produce an undesirable force on self-propelled cleaning carriage 404. For example, wheels of self-propelled cleaning carriage 404 may slip relative to retractable assembly 402 if an undesirable amount of tension is on the hoses connected to self-propelled cleaning carriage 404.

Self-propelled cleaning carriage 404 may include air knife 454, rinse nozzles 456, and detergent nozzles 458. Each of air knife 454, rinse nozzles 456, and detergent nozzles 458 may dispense utilities into a vessel to clean the vessel. For example, detergent nozzles 458 may spray detergent onto the walls of a vessel. Rinse nozzles 456 may spray rinse water onto the walls of a vessel. Air knife 454 may direct a stream of compressed air towards the walls of the vessel. Air knife 454 may dry the walls of the vessel.

Self-propelled cleaning carriage 404 may be driven by air motor 460. Air motor 460 may receive air through an air hose to drive air motor 460. Valve 462 may be used to change the direction self-propelled cleaning carriage 404 moves in a vessel.

Figure 5:
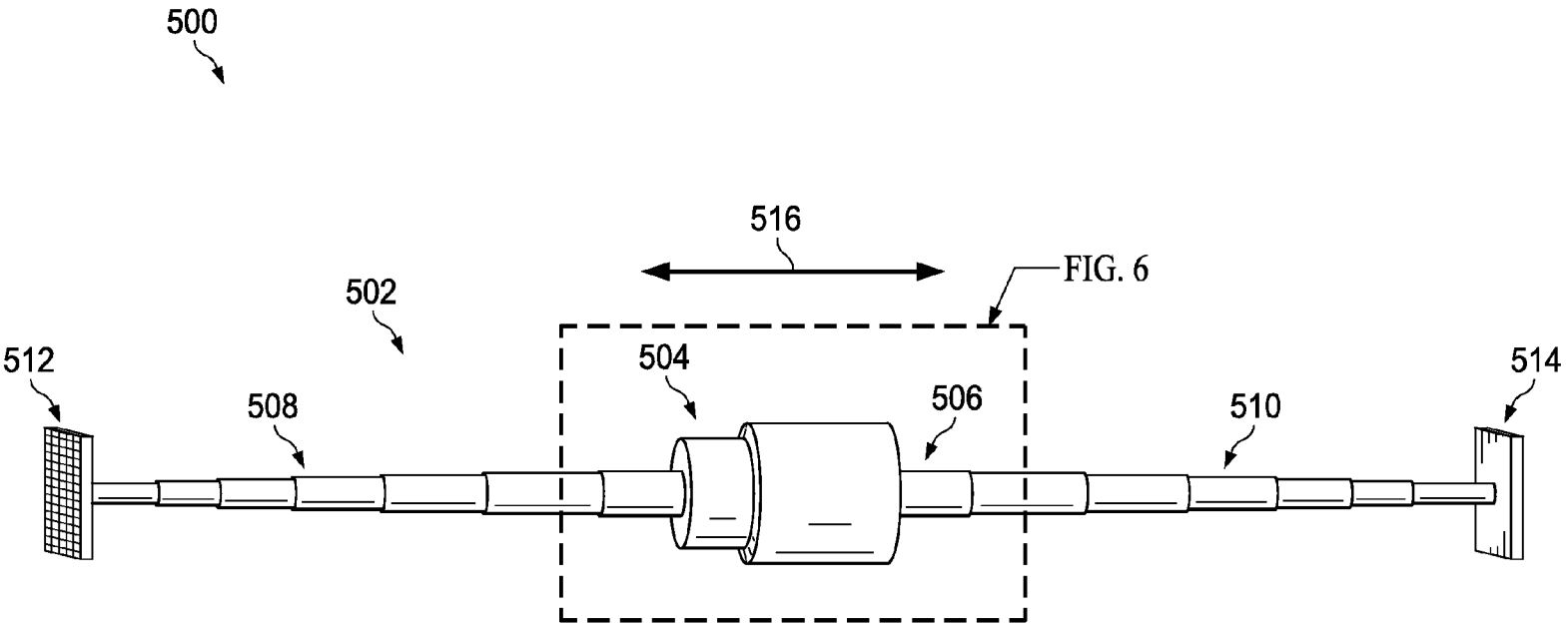
FIG. 5 is an illustration of a side view of a cleaning system in accordance with an illustrative embodiment.

Turning now to FIG. 5, an illustration of a side view of a cleaning system is depicted in accordance with an illustrative embodiment. Cleaning system 500 may be a physical implementation of cleaning system 302 of FIG. 3. Cleaning system 500 may be used to clean an interior of a vessel such as fuel tank 200 of FIG. 2.

As depicted, cleaning system 500 includes retractable assembly 502 and self-propelled cleaning carriage 504. Retractable assembly 502 includes center section 506, first segmented arm 508 and second segmented arm 510. First gripper 512 is attached to first segmented arm 508. Second gripper 514 is attached to second segmented arm 510. Self-propelled cleaning carriage 504 may be moved in direction 516 along retractable assembly 502. Retractable assembly 502 may be extended in direction 516 to contact walls of a vessel.

Figure 6:
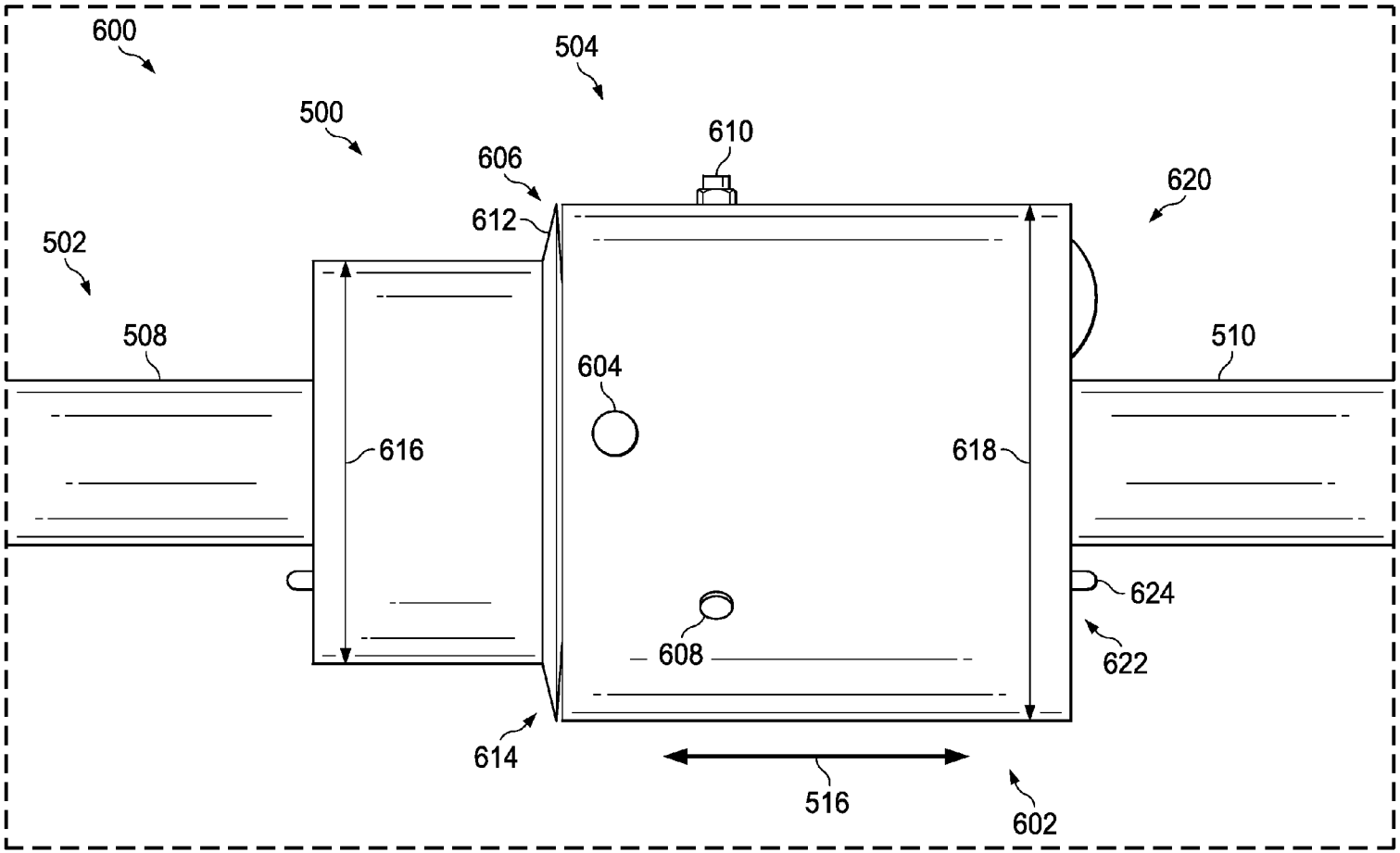
FIG. 6 is an illustration of a side view of a cleaning system in accordance with an illustrative embodiment.

Turning now to FIG. 6, an illustration of a side view of a cleaning system is depicted in accordance with an illustrative embodiment. View 600 is a view of cleaning system 500 within box 5 of FIG. 5.

As depicted, self-propelled cleaning carriage 504 has plurality of detergent sprayers 602, water sprayer 604, and air nozzle 606. In view 600, detergent sprayer 608 and detergent sprayer 610 of plurality of detergent sprayers 602 can be seen. Although only water sprayer 604 is shown in view 600, additional water sprayers may be positioned around cleaning system 500 such that a desirable amount of a vessel is sprayed. For example, additional water sprayers may be positioned around cleaning system 500 such that 4 pi steradians of water may be sprayed from self-propelled cleaning carriage 504. Water sprayers may be positioned around self-propelled cleaning carriage 504 such that water may be sprayed onto desirable areas of a vessel without rotating the water sprayers relative to self-propelled cleaning carriage 504.

As depicted, air nozzle 606 takes the form of air knife 612. Air knife 612 may be positioned at change 614 between first diameter 616 and second diameter 618. As self-propelled cleaning carriage 504 moves in direction 516, plurality of detergent sprayers 602 may spray detergent on the walls of the vessel. As self-propelled cleaning carriage 504 moves in direction 516, water sprayer 604 may spray rinse water on the walls of a vessel. As self-propelled cleaning carriage 504 moves in direction 516, air knife 612 may spray compressed air in 360 degrees from self-propelled cleaning carriage 504.

Self-propelled cleaning carriage 504 may be propelled in direction 516 by plurality of drive wheels 620. As depicted, plurality of drive wheels 620 includes three concave wheels contacting second segmented arm 510. Valve 622 may be used to control movement of self-propelled cleaning carriage 504. Valve 622 may have directional shaft 624. Self-propelled cleaning carriage 504 may move in an opposite direction after actuating valve 622 using directional shaft 624.

Figure 7:
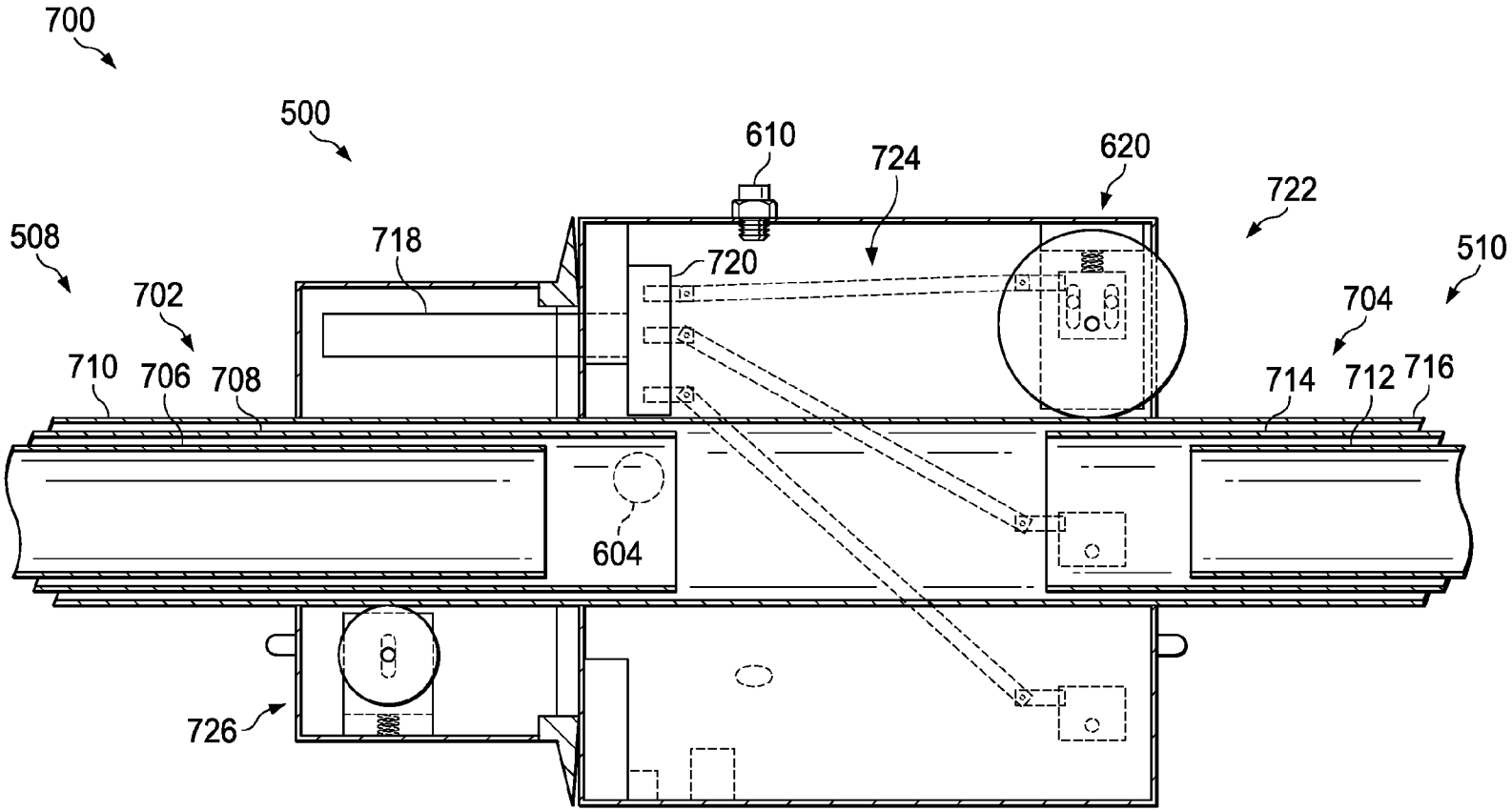
FIG. 7 is an illustration of a cross-sectional view of a cleaning system in accordance with an illustrative embodiment.

Turning now to FIG. 7, an illustration of a cross-sectional view of a cleaning system is depicted in accordance with an illustrative embodiment. View 700 may be a cross-sectional view of cleaning system 500. As can be seen in view 700, first segmented arm 508 includes first plurality of concentric hollow rods 702. Further, second segmented arm 510 includes second plurality of concentric hollow rods 704. First plurality of concentric hollow rods 702 includes rod 706, rod 708, and rod 710. Rod 706 is located within rod 708. Rod 708 is located within rod 710. Second plurality of concentric hollow rods 704 includes rod 712, rod 714, and rod 716. Rod 712 is within rod 714. Rod 714 is within rod 716.

The respective lengths of each of first plurality of concentric hollow rods 702 may be substantially the same as a length of one of second plurality of concentric hollow rods 704. The length of each of first plurality of concentric hollow rods 702 may be selected based on a size of a vessel to be cleaned. The length of each of first plurality of concentric hollow rods 702 may be selected to reduce the weight of cleaning system 500 to a desirable value.

In some illustrative examples, the respective lengths of each of second plurality of concentric hollow rods 704 may be the same as at least one of the respective lengths of first plurality of concentric hollow rods 702. The length of each of second plurality of concentric hollow rods 704 may be selected based on a size of a vessel to be cleaned.

Self-propelled cleaning carriage 504 may include air motor 718, gear box 720, and plurality of drive wheels 722. Plurality of drive wheels 722 are connected to gear box 720 by plurality of drive shafts 724.

Self-propelled cleaning carriage 504 may also include plurality of idle wheels 726. As depicted, plurality of idle wheels 726 are smaller than plurality of drive wheels 722. As depicted, self-propelled cleaning carriage 504 has three drive wheels. Further, self-propelled cleaning carriage 504 has three idle wheels.

Figure 8:
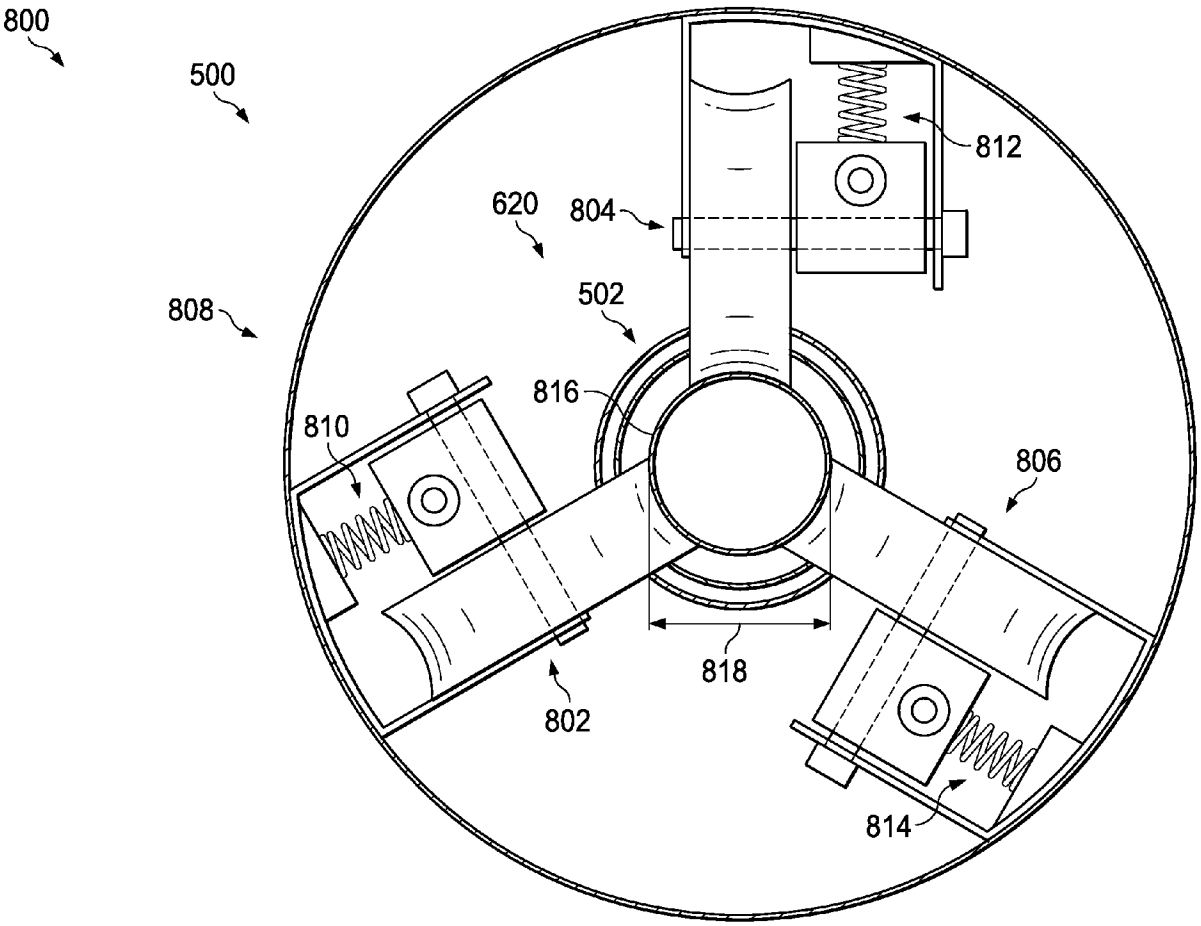
FIG. 8 is an illustration of a front cross-sectional view of a cleaning system in accordance with an illustrative embodiment.

Turning now to FIG. 8, an illustration of a front cross-sectional view of a cleaning system is depicted in accordance with an illustrative embodiment. View 800 depicts plurality of drive wheels 620 contacting retractable assembly 502. Plurality of drive wheels 620 includes drive wheel 802, drive wheel 804, and drive wheel 806. As depicted, plurality of biasing systems 808 bias drive wheel 802, drive wheel 804, and drive wheel 806 towards retractable assembly 502. As depicted, each of plurality of biasing systems 808 has a spring. In this illustrative example, each of spring 810, spring 812, and spring 814 are expanded such that drive wheel 802, drive wheel 804, and drive wheel 806 contact retractable assembly 502.

In view 800, plurality of drive wheels 620 are contacting hollow rod 816. Hollow rod 816 may be a physical implementation of any of first plurality of concentric hollow rods 336 or second plurality of concentric hollow rods 338 shown in block form in FIG. 3. In some illustrative examples, hollow rod 816 may be a rod of one of first plurality of concentric hollow rods 702 or second plurality of concentric hollow rods 704. As depicted, hollow rod 816 has diameter 818.

Figure 9:
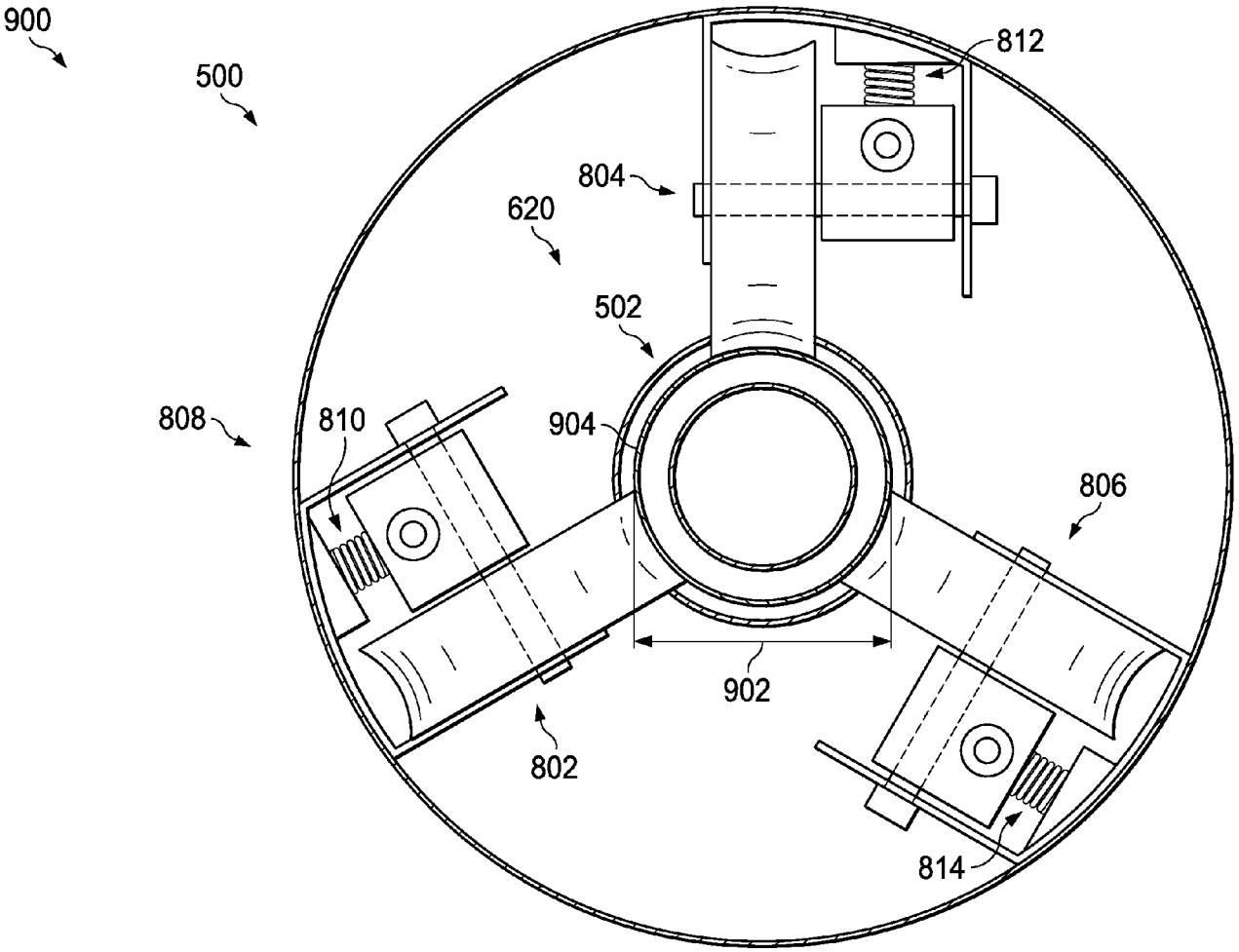
FIG. 9 is an illustration of a front cross-sectional view of a cleaning system in accordance with an illustrative embodiment.

Turning now to FIG. 9, an illustration of a front cross-sectional view of a cleaning system is depicted in accordance with an illustrative embodiment. View 900 depicts plurality of drive wheels 620 contacting retractable assembly 502. As depicted, plurality of biasing systems 808 bias drive wheel 802, drive wheel 804, and drive wheel 806 towards retractable assembly 502. As depicted, each of plurality of biasing systems 808 has a spring. As depicted, each of spring 810, spring 812, and spring 814 are compressed such that drive wheel 802, drive wheel 804, and drive wheel 806 contact retractable assembly 502. In view 900, diameter 902 of hollow rod 904 is greater than diameter 818 of hollow rod 816 in FIG. 8. As self-propelled cleaning carriage 504 moves along retractable assembly 502, each of spring 810, spring 812, and spring 814 may compress as retractable assembly 502 increases in diameter. As self-propelled cleaning carriage 504 moves along retractable assembly 502, each of spring 810, spring 812, and spring 814 may expand as retractable assembly 502 decreases in diameter.

Figure 10:
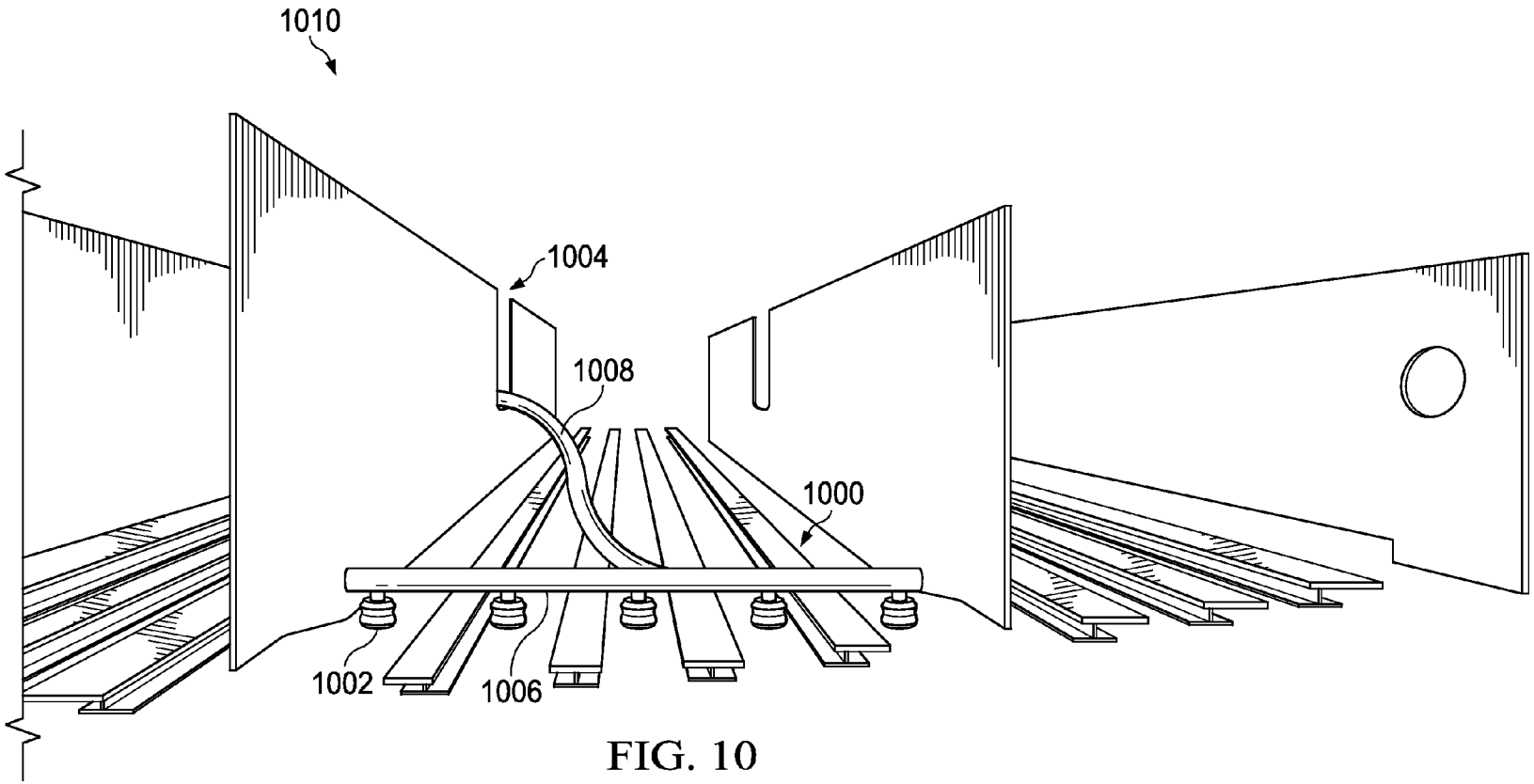
FIG. 10 is an illustration of a vacuum assembly in accordance with an illustrative embodiment.

Turning now to FIG. 10, an illustration of a vacuum assembly is depicted in accordance with an illustrative embodiment. Vacuum assembly 1000 may be a physical implementation of vacuum assembly 380 of FIG. 3. Vacuum assembly 1000 includes plurality of vacuum suction cups 1002 and channel 1004. As depicted, channel 1004 includes substantially rigid portion 1006 and hose 1008. Plurality of vacuum suction cups 1002 may hold vacuum assembly 1000 in place within vessel 1010. Plurality of vacuum suction cups 1002 may also pull detergent, rinse water, debris, or other materials from within vessel 1010. Slits within plurality of vacuum suction cups 1002 may create routes for detergent, rinse water, debris, or other materials to enter channel 1004. Vacuum assembly 1000 may stay in place within vessel 1010 as a self-propelled cleaning carriage, such as self-propelled cleaning carriage 328 of FIG. 3, cleans vessel 1010. Although a self-propelled cleaning carriage may move within vessel 1010 as it cleans, vacuum assembly 1000 may remain in substantially the same location during cleaning.

The different components shown in FIGS. 1-2 and FIGS. 4-10 may be combined with components in FIG. 3, used with components in FIG. 3, or a combination of the two. Additionally, some of the components in FIGS. 1-2 and FIGS. 4-10 may be illustrative examples of how components shown in block form in FIG. 3 can be implemented as physical structures.

Figure 11:
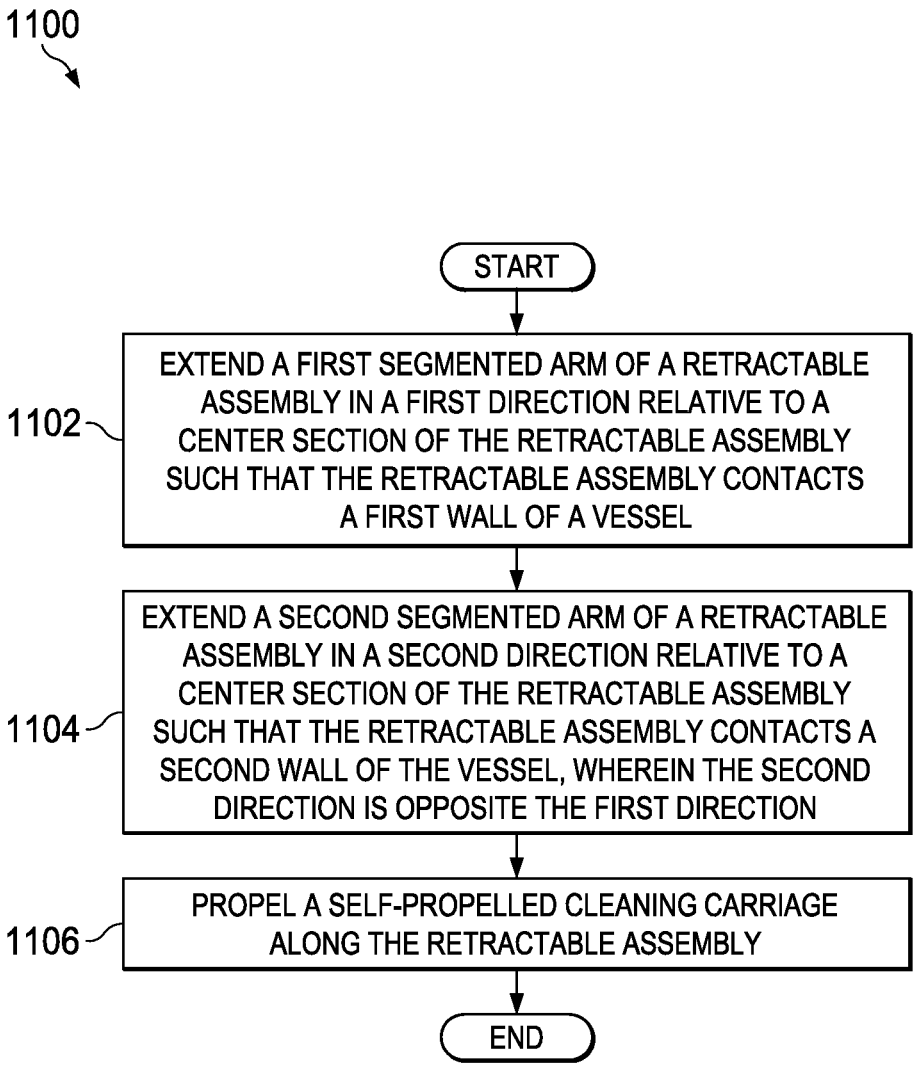
FIG. 11 is an illustration of a flowchart of a process for cleaning a vessel in accordance with an illustrative embodiment.

Turning now to FIG. 11, an illustration of a flowchart of a process for cleaning a vessel is depicted in accordance with an illustrative embodiment. Process 1100 may extend a first segmented arm of a retractable assembly in a first direction relative to a center section of the retractable assembly such that the retractable assembly contacts a first wall of a vessel (operation 1102). In some illustrative examples, the first segmented arm may be extended using pneumatic pressure.

When the first segmented arm of the retractable assembly is extended in a first direction, overlap of nested hollow rods of the first segmented arm may be reduced.

Process 1100 may extend a second segmented arm of a retractable assembly in a second direction relative to a center section of the retractable assembly such that the retractable assembly contacts a second wall of the vessel, wherein the second direction is opposite the first direction (operation 1104). In some illustrative examples, the second segmented arm may be extended using pneumatic pressure. In some illustrative examples, the first segmented arm and the second segmented arm may be extended substantially simultaneously. In some illustrative examples, by extending both the first segmented arm and the second segmented arm simultaneously, a center section of the retractable assembly may be substantially centered within the vessel. When the second segmented arm of the retractable assembly is extended in the second direction, overlap of nested hollow rods of the second segmented arm may be reduced.

Next, process 1100 may propel a self-propelled cleaning carriage along the retractable assembly (operation 1106). Afterwards the process terminates. The self-propelled cleaning carriage may be concentric with the retractable assembly. The retractable assembly may run through a center shroud of the self-propelled cleaning carriage. In some illustrative examples, the self-propelled cleaning carriage may be propelled along the retractable assembly by at least one of an air motor and a number of concave wheels.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent at least one of a module, a segment, a function, or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

For example, process 1100 may include further operations. In one illustrative example, process 1100 may further include connecting a detergent hose to the self-propelled cleaning carriage. The detergent hose may be disconnected from the self-propelled cleaning carriage after spraying detergent in the vessel and prior to rinsing the detergent from the vessel. A rinse hose may be connected to the self-propelled cleaning carriage after disconnecting the detergent hose. The rinse hose may be disconnected from the self-propelled cleaning carriage after rinsing the detergent from the vessel.

In some illustrative examples, disconnecting the rinse hose from the self-propelled cleaning carriage after rinsing the detergent from the vessel may be performed prior to drying the vessel. Process 1100 may include connecting an air hose to the self-propelled cleaning carriage. An air stream may be directed towards the vessel to dry the vessel. The air hose may be disconnected from the self-propelled cleaning carriage after drying the vessel.

In some illustrative examples, process 1100 may also spray detergent into the vessel using a plurality of detergent sprayers. The vessel may be rinsed using water sprayed into the vessel using a plurality of water sprayers. The vessel may be dried using an air nozzle. In some illustrative examples, process 1100 may also actuate a valve of the self-propelled cleaning carriage with a component of the retractable assembly to reverse the direction of the self-propelled cleaning carriage.

Figure 12:
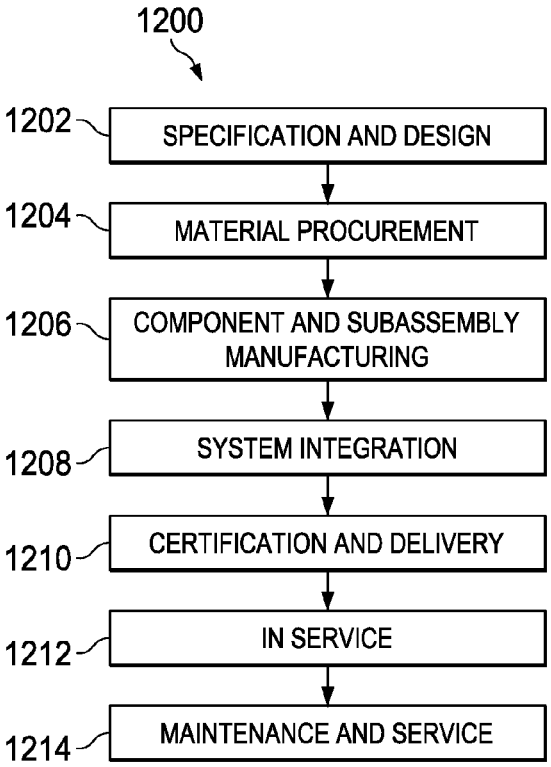
FIG. 12 is an illustration of an aircraft manufacturing and service method in the form of a block diagram in accordance with an illustrative embodiment.
Figure 13:
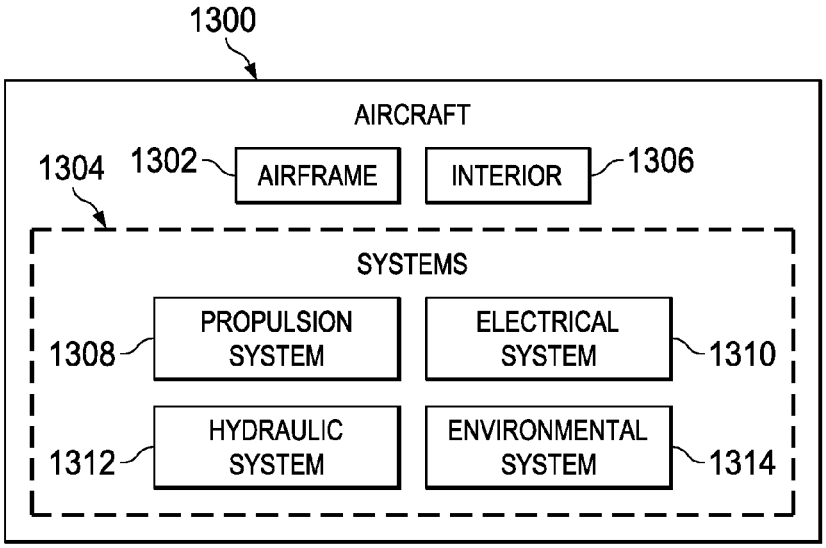
FIG. 13 is an illustration of an aircraft in the form of a block diagram in which an illustrative embodiment may be implemented.

The illustrative embodiments of the disclosure may be described in the context of aircraft manufacturing and service method 1200 as shown in FIG. 12 and aircraft 1300 as shown in FIG. 13. Turning first to FIG. 12, an illustration of an aircraft manufacturing and service method is depicted in the form of a block diagram in accordance with an illustrative embodiment. During pre-production, aircraft manufacturing and service method 1200 may include specification and design 1202 of aircraft 1300 in FIG. 13 and material procurement 1204.

During production, component and subassembly manufacturing 1206 and system integration 1208 of aircraft 1300 in FIG. 13 takes place. Thereafter, aircraft 1300 in FIG. 13 may go through certification and delivery 1210 in order to be placed in service 1212. While in service 1212 by a customer, aircraft 1300 in FIG. 13 is scheduled for routine maintenance and service 1214, which may include modification, reconfiguration, refurbishment, and other maintenance or service.

Each of the processes of aircraft manufacturing and service method 1200 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 13, an illustration of an aircraft is depicted in the form of a block diagram in which an illustrative embodiment may be implemented. In this example, aircraft 1300 is produced by aircraft manufacturing and service method 1200 in FIG. 12 and may include airframe 1302 with plurality of systems 1304 and interior 1306. Examples of systems 1304 include one or more of propulsion system 1308, electrical system 1310, hydraulic system 1312, and environmental system 1314. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 1200 in FIG. 12. One or more illustrative embodiments may be used during component and subassembly manufacturing 1206. For example, cleaning system 302 of FIG. 3 may be used during component and subassembly manufacturing 1206 to remove any undesirable materials from propulsion system 1308 or airframe 1302 of aircraft 1300. Further, cleaning system 302 of FIG. 3 may be used to clean portions of aircraft 1300 after performing replacements during maintenance and service 1214.

The illustrative embodiments provide a method and apparatus for cleaning a vessel. Cleaning system 302 may be used to clean any desirable type of vessel. In some illustrative examples, cleaning system 302 may be used to clean a fuel tank of an aircraft.

The cleaning system may include a retractable assembly and a self-propelled cleaning carriage. The retractable assembly may be designed to fit within a confined space. The retractable assembly may be designed to be deployed within a vessel without an operator being present within the vessel. The retractable assembly may include two segmented arms. The arms of the retractable assembly may be extended using pneumatic pressure. The self-propelled cleaning carriage may be positioned on a center section of the retractable assembly while the retractable assembly is extended.

The cleaning system may reduce at least one of labor costs, rework costs, rework time, or cleaning time for a vessel. For example, the cleaning system may reduce the time to clean an aircraft fuel tank by providing an autonomous cleaning system. Further, the cleaning system may not cause undesirable quality in a fuel tank. The cleaning system may not mechanically scrub the interior of the fuel tank. Thus, the cleaning system may not cause an undesirable quality for which rework may be performed. By reducing rework, at least one of the manufacturing time or the manufacturing cost of an aircraft may be reduced. Yet further, the cleaning system may boost morale as an operator may not have to don protective gear and contort his body into uncomfortable positions. Yet further, the cleaning system may boost morale as an operator may not have to spend time in confined spaces which may be undesirably hot or undesirably small.

The self-propelled cleaning carriage may move along the retractable assembly to clean the vessel. Biasing systems may bias the drive wheels of the self-propelled cleaning carriage to the retractable assembly. The biasing systems may prevent or reduce slippage of the drive wheels relative to the retractable assembly. The biasing systems may bias the drive wheels of the self-propelled cleaning carriage as the self-propelled cleaning carriage moves along hollow rods having different diameters.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a retractable assembly having a center section, a first segmented arm configured to extend in a first direction from the center section, and a second segmented arm configured to extend in a second direction from the center section, wherein the second direction is opposite the first direction; and a self-propelled cleaning carriage surrounding at least a portion of the retractable assembly, wherein the self-propelled cleaning carriage is configured to move along at least one of the first segmented arm or the second segmented arm.

2. The apparatus of claim 1, wherein the self-propelled cleaning carriage is concentric with the retractable assembly.

3. The apparatus of claim 1, wherein the first segmented arm comprises a first plurality of concentric hollow rods, and wherein the second segmented arm comprises a second plurality of concentric hollow rods.

4. The apparatus of claim 1, wherein the retractable assembly further comprises a first gripper attached to the first segmented arm and a second gripper attached to the second segmented arm.

5. The apparatus of claim 1 further comprising:

a pneumatic system associated with the retractable assembly.

6. The apparatus of claim 1, wherein the self-propelled cleaning carriage comprises a plurality of detergent sprayers and a plurality of water sprayers.

7. The apparatus of claim 1, wherein the self-propelled cleaning carriage comprises an air nozzle.

8. The apparatus of claim 7, wherein the air nozzle comprises an air knife.

9. The apparatus of claim 8, wherein the air nozzle is associated with a change in diameter of the self-propelled cleaning carriage.

10. The apparatus of claim 1, wherein the retractable assembly contacts a first wall and a second wall of a vessel, the apparatus further comprising:

a vacuum assembly having a plurality of vacuum suction cups and a channel connected to each of the plurality of vacuum suction cups, wherein the plurality of vacuum suction cups holds the vacuum assembly to a floor of the vessel.

11. An apparatus comprising:

a retractable assembly comprising:

a center section;

a first segmented arm having a first plurality of concentric hollow rods and configured to extend in a first direction from the center section;

a second segmented arm having a second plurality of concentric hollow rods and configured to extend in a second direction from the center section, wherein the second direction is opposite the first direction;

a first gripper attached to the first segmented arm; and a second gripper attached to the second segmented arm;

a pneumatic system associated with the retractable assembly; and a self-propelled cleaning carriage surrounding at least a portion of the retractable assembly, wherein the self-propelled cleaning carriage is configured to move along at least one of the first segmented arm or the second segmented arm.

12. The apparatus of claim 11, wherein the self-propelled cleaning carriage comprises:

a plurality of detergent sprayers;

a plurality of water sprayers; and an air nozzle.

13. The apparatus of claim 12, wherein the air nozzle is associated with a change in diameter of the self-propelled cleaning carriage.

14. The apparatus of claim 11, wherein the self-propelled cleaning carriage comprises a valve configured to interact with a component of the retractable assembly to reverse a direction of the self-propelled cleaning carriage.

15. The apparatus of claim 11, wherein the retractable assembly contacts a first wall and a second wall of a vessel, the apparatus further comprising:

a vacuum assembly having a plurality of vacuum suction cups and a channel connected to each of the plurality of vacuum suction cups, wherein the plurality of vacuum suction cups holds the vacuum assembly to a floor of the vessel.

16. A method comprising:

extending a first segmented arm of a retractable assembly in a first direction relative to a center section of the retractable assembly such that the retractable assembly contacts a first wall of a vessel;

extending a second segmented arm of the retractable assembly in a second direction relative to the center section of the retractable assembly such that the retractable assembly contacts a second wall of the vessel, wherein the second direction is opposite the first direction; and propelling a self-propelled cleaning carriage along one of the first extended segmented arm or the second extended segmented arm of the retractable assembly.

17. The method of claim 16 further comprising:

spraying detergent into the vessel using a plurality of detergent sprayers;

rinsing the vessel using water sprayed into the vessel using a plurality of water sprayers; and drying the vessel using an air nozzle.

18. The method of claim 17 further comprising:

connecting a detergent hose to the self-propelled cleaning carriage;

disconnecting the detergent hose from the self-propelled cleaning carriage after spraying detergent in the vessel, and prior to rinsing the detergent from the vessel;

connecting a rinse hose to the self-propelled cleaning carriage after disconnecting the detergent hose; and disconnecting the rinse hose from the self-propelled cleaning carriage after rinsing the detergent from the vessel.

19. The method of claim 18, wherein disconnecting the rinse hose from the self-propelled cleaning carriage after rinsing the detergent from the vessel is performed prior to drying the vessel, and further comprising:

connecting an air hose to the self-propelled cleaning carriage;

drying the vessel by directing an air stream towards the vessel; and disconnecting the air hose from the self-propelled cleaning carriage after drying the vessel.

20. The method of claim 16 further comprising:

actuating a valve of the self-propelled cleaning carriage with a component of the retractable assembly to reverse a direction of the self-propelled cleaning carriage.

* * * * *